United States Patent [19]

Drummond

[11] 4,307,497

[45] Dec. 29, 1981

[54] METHOD OF TREATING TEXTILE YARNS

[75] Inventor: Warren W. Drummond, Allison Park, Pa.

[73] Assignee: PPG Industries, Inc., Pittsburgh, Pa.

[21] Appl. No.: 849,823

[22] Filed: Nov. 9, 1977

Related U.S. Application Data

[63] Continuation-in-part of Ser. No. 793,590, May 4, 1977, abandoned.

[51] Int. Cl.[3] ..... D02G 1/16

[52] U.S. Cl. ..... 28/271; 57/333

[58] Field of Search ..... 28/271, 272, 275; 57/77.3, 333

[56] References Cited

U.S. PATENT DOCUMENTS

| | | |
|---|---|---|
| 2,990,671 | 7/1961 | Bunting, Jr. et al. . |
| 3,009,309 | 11/1961 | Breen et al. . |
| 3,079,745 | 3/1963 | Breen et al. . |
| 3,262,179 | 7/1966 | Sparling . |
| 3,831,363 | 8/1974 | Pike . |
| 4,003,111 | 1/1977 | Drummond . |
| 4,020,623 | 5/1977 | Drummond . |
| 4,045,195 | 8/1977 | Drummond . |

*Primary Examiner*—Robert Mackey

*Attorney, Agent, or Firm*—Kenneth J. Stachel; Alan T. McDonald; Paul A. Leipold

[57] ABSTRACT

A method is disclosed for the treatment of textile yarns of filamentary material, such as glass fiber yarns. The yarn passes through a fluid jet which includes a central chamber which is formed from a pair of interconnected and overlapping passageways. Each passageway includes one or more fluid inlets along its length to allow treating fluid to pass circumferentially around each passageway in a counterdirectional pattern. The textile yarn passes between the passageways in the chamber and the filaments in the yarn are entangled with each other to consolidate and round the yarn without a true or false twist being placed on the yarn. Depending upon the amount of tension in the yarn, the fluid pressure in the jet and the speed of the yarn through the jet, the degree of entanglement can be varied. Under low to zero tensions, texturized yarns and yarns having slubs thereon can be produced.

4 Claims, 8 Drawing Figures

METHOD OF TREATING TEXTILE YARNS

CROSS-REFERENCE TO RELATED APPLICATIONS

This is a continuation-in-part of U.S. Application Ser. No. 793,590, filed May 4, 1977, now abandoned.

BACKGROUND OF THE INVENTION

In U.S. Pat. No. 3,009,309 fluid jets are disclosed for treating textile yarns. These jets include a central chamber through which the yarn may pass and a plurality of fluid inlets arranged along the chamber to allow gaseous treating fluid to pass circumferentially around the chamber. This treating fluid produces a yarn which is rounder and more compact in appearance than the flat yarns typically produced in a glass fiber yarn forming operation. The yarn produced in this manner is "false twisted", i.e., appears to be twisted continuously in one direction. Yarn, as referred to in this specification, includes twisted yarns, untwisted strands, rovings of strands and the like.

In U.S. Pat. Nos. 2,990,671 and 3,079,745, fluid jets are disclosed which includes a pair of opposing treating chambers. These jets are employed to produce a plurality of alternate direction false twists in the yarn by maintaining the yarn in the opposing chambers for a significant length of time to produce a plurality of twists in the yarn in each direction before moving the yarn into the other chamber.

While the yarns produced in these manners have utility in fabric production, it is often desirable to produce textile fabrics having novelty patterns, such as slubs and other texturized effects. It is also desirable to produce textile yarns which are not twisted or false twisted, but which are consolidated and rounded to such a degree that the yarns will process satisfactorily in weaving and other textile operations.

In co-pending U.S. Application Ser. No. 749,198 now U.S. Pat. No. 4,096,685 granted June 27, 1978, which is incorporated herein by reference, numerous nozzled apparatuses are disclosed for producing slubbed yarns. It is theorized that the slubs are provided by a "double-vortex" effect. Thus, a pair of counterdirectional gaseous fluid streams are created within a treatment zone by the nozzles, with the yarn alternately passing within the gaseous fluid streams and with the counterdirectional gaseous fluid streams twisting and untwisting the yarn in opposite directions. At the null points, i.e., the points of direction reversals in the twist, slubs are produced in the yarn.

While the texturizing apparatuses of U.S. Ser. No. 749,198 have provided slub yarns of good quality, it is desirable to more precisely control the production of these yarns and to highlight the "double-vortex" effect which is believed to produce these slubs. At the same time, it is desirable to produce numerous and varied textile texturizing effects on a textile yarn under various fluid pressures and with different levels of tension on the yarn. It is also desirable to produce untwisted and untexturized yarns which will process satisfactorily in textile operations. Further, it is desirable to produce such yarns from a fluid jet which requires no nozzle which must be carefully adjusted to produce the desired effects.

THE PRESENT INVENTION

By means of the present invention, all of the previously mentioned desirable properties for a yarn treating operation are realized. The method of the present invention involves treating the yarn in a fluid jet having a central chamber through which the yarn passes. This chamber comprises a pair of interconnected and overlapped passageways. In cross section, the chamber generally resembles a figure-eight. Located along the length of each passageway of the chamber is one or more fluid inlets. These inlets are constructed and arranged to direct treating fluid circumferentially and counterdirectionally around each of the passageways formed by the chamber walls. The yarn employed may be any desired textile material such as nylon, polyester, glass, acetate, cotton and the like. The yarn passing through the jet generally follows the walls of the passageways as it is moved around them by the fluid, thus being alternately treated with treatment fluid in the clockwise and counterclockwise directions as it is introduced alternately into the two passageways of the chamber. The yarn revolves around each passageway in the chamber a single time and immediately passes to the other chamber continuously so that no true twist is placed on the yarn. This fluid treatment in alternate directions produces a yarn which is rounded and compact due to the entanglement of the filaments of the yarn with one another. The yarn produced is not true or false twisted, due to the alternate directions of the fluid treatment upon the yarn. Under levels of relatively high rension, such as in a glass yarn forming operation, there is little or no texturizing of the yarn, but merely the formation of a generally rounded and compact yarn. However, under somewhat lower tensions, a texturized yarn results. Under extremely low to zero tensions, slubs are formed at the null points between the alternate direction fluid treatments. Thus, the method of the present invention is capable of producing many varied textile yarns by control of the speed of passage of the yarn through the fluid jet, the tension on the yarn passing through the jet and the pressure of the treating fluid in the jet.

BRIEF DESCRIPTION OF THE DRAWINGS

The present invention will be more fully described with reference to the drawings in which.

DETAILED DESCRIPTION OF THE DRAWINGS

Figure 3:
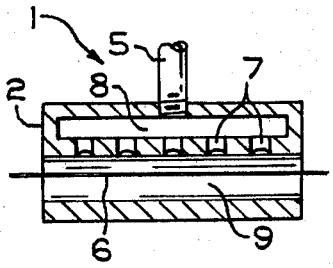
FIG. 3 is a cross-sectional view of the jet taken through line 3—3 of FIG. 2.
Figure 1:
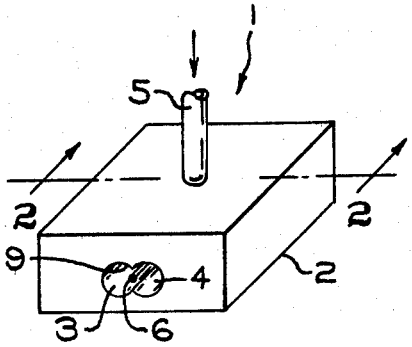
FIG. 1 is a perspective view of the fluid jet employed in the present invention.
Figure 2:
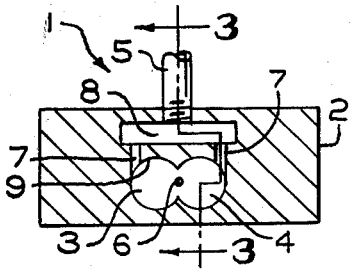
FIG. 2 is a cross-sectional view of the jet taken through line 2—2 of FIG. 1.

The fluid jet employed in the present invention is illustrated in FIGS. 1, 2 and 3. The jet 1 comprises a body 2 having a pair of interconnected and overlapping passageways 3 and 4 along its length. The passageways 3 and 4 are interconnected and overlapped along their lengths such that the result is a complete chamber 9 formed in the walls of the jet 1 through which yarn 6 may pass. This chamber 9 generally resembles a figure-eight in shape. While the interconnected passages 3 and 4 are shown as being round, they may take any desired shape. Thus, elliptical, triangular, oval and other like shapes are contemplated, with the result that the chamber 9 resembles generally a figure-eight pattern.

As can best be seen in FIGS. 2 and 3, each of the passageways 3 and 4 are connected along their lengths in fluid transfer relation to one or more fluid inlets 7 which are constructed and arranged to direct treating fluid, and preferably gaseous fluids, such as air, oxygen, nitrogen and the like, circumferentially around the passageways 3 and 4 in countercurrent directions. The fluid inlets 7 are preferably connected to a common fluid chamber 8 which is in turn connected to fluid intake or feedline 5.

The jet 1 may be formed of numerous materials, including plastic, ceramic, glass and metal. Preferably, the jet 1 is constructed of a metal, such as brass or stainless steel.

The jet may be formed as a single piece, with the chamber 9 being formed by a pair of overlapped drillings into the walls of the jet 1. The fluid inlets 7 and common fluid chamber or header 8 are then drilled into the body 2, with plugs employed to seal the inlets 7 and fluid chamber 8 at their ends.

The jet may also be formed of two or more sections. Thus, for example, two sections may be machined to be connected at the overlap and interconnection of the passageways 3 and 4 or at the connection of the fluid inlets 7 to the passageways 3 and 4, or a combination of these may also be employed.

As previously mentioned, the chamber 9 is formed by the intersecting, overlapping passageways 3 and 4. The chamber 9 is thus formed within the walls of the body 2. At the intersection and overlap of the passageways 3 and 4, there is a constriction in the chamber 9. Thus, the height of the chamber 9 at the intersection of the passageways 3 and 4 is less than the height at the center of the passageways 3 and 4. Also, the cross-sectional area of the intersection is smaller than the balance of either passageway 3 or 4.

Again looking at the chamber 9, the chamber may be formed of four arcs, two of which are approximately colinear and the other two arcs being mirror images of the first two. The central positions of the approximately colinear arcs intersect and overlap one another to form the constriction previously described.

Figure 8:
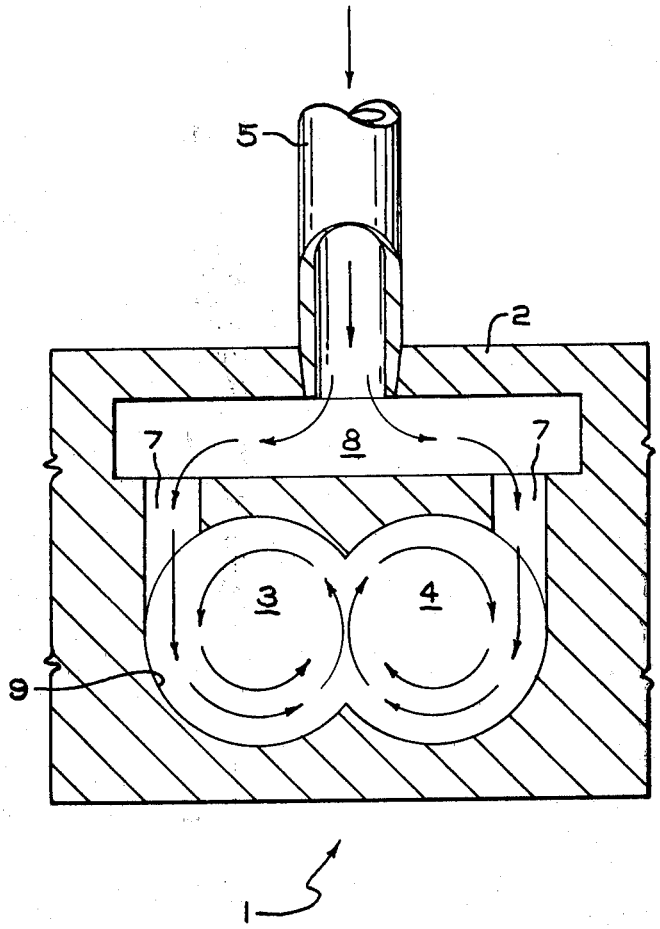
FIG. 8 is an expanded view of the passageways in the jet, illustrating the fluid flow in the chamber.

The fluid flow through the jet 1 can best be seen in FIG. 8. As the yarn 6 passes through the jet 1, it is alternately caught up in the countercurrent fluid streams formed in each of the passages 3 and 4. The treating fluid entangles the filaments of the yarn 6 with one another. As the yarn 6 follows the fluid streams, and thus generally follows the contours of the chamber 9, the yarn 6 makes a single revolution around each passageway 3 or 4 prior to its moving into the other passageway. Due to the constantly changing direction of the fluid treatment on the yarn 6, the yarn 6 follows the generally figure-eight shape of the chamber 9. No false twist is placed in this yarn 6, since each false twist which is placed into the yarn 6 in one direction is immediately removed by the fluid treatment in the opposite direction.

Under fairly high tensions, such as those encountered in glass yarn formation, the effect on the yarn 6 is to entangle the filaments with one another and to produce a compact, well-consolidated and generally rounded yarn. This is in contrast to the generally flat yarn which is typically produced in glass fiber forming operations.

Under somewhat lower tensions, and depending upon the speed of travel of the yarn 6 through the jet 1 and the fluid pressure in the jet 1, the yarn may be texturized along its entire length. If the tension and speed of travel for the yarn 6 through the jet 1 and the fluid pressure through the inlets 7 are further adjusted, a slubby yarn can be produced, with texturized slubs being formed at each null point where the yarn 6 crosses between passageways 3 and 4.

The degree of either of the texturization or slubbiness in the yarn 6 can be varied by adjusting the speed of travel of the yarn 6 through the jet 1, the level of tension in the yarn 6 as it passes through the jet 1 and the gaseous fluid pressure in the jet 1. In addition, the jet 1 can be combined in an operation with other fluid jets to produce various textile yarns.

The action which produces slubs in the yarn under low tension and which prohibits the true or false twisting of the yarn 6 is believed to be a "double-vortex" effect. As the yarn 6 passes through passageway 3, it is treated by fluid flowing in a counter-clockwise direction for a single revolution of the yarn 6 around passageway 3. When the yarn 6 then passes within passageway 4, it is subjected to treating fluid flowing in a clockwise direction for a single revolution of the yarn 6 around passageway 4. Thus, any false twist which may be placed in the yarn 6 during its passage through passageway 3 is removed by its passage through passageway 4 and vice versa. Under reduced tensions, at the null points, i.e. the points of direction reversal of the treating fluid seen by the yarn 6 as it moves from passageway 3 to passageway 4 and from passageway 3, a texturized slub is produced.

FIGS. 4, 5, 6 and 7 illustrate various operations in which the method of the present invention may be employed.

Figure 4:
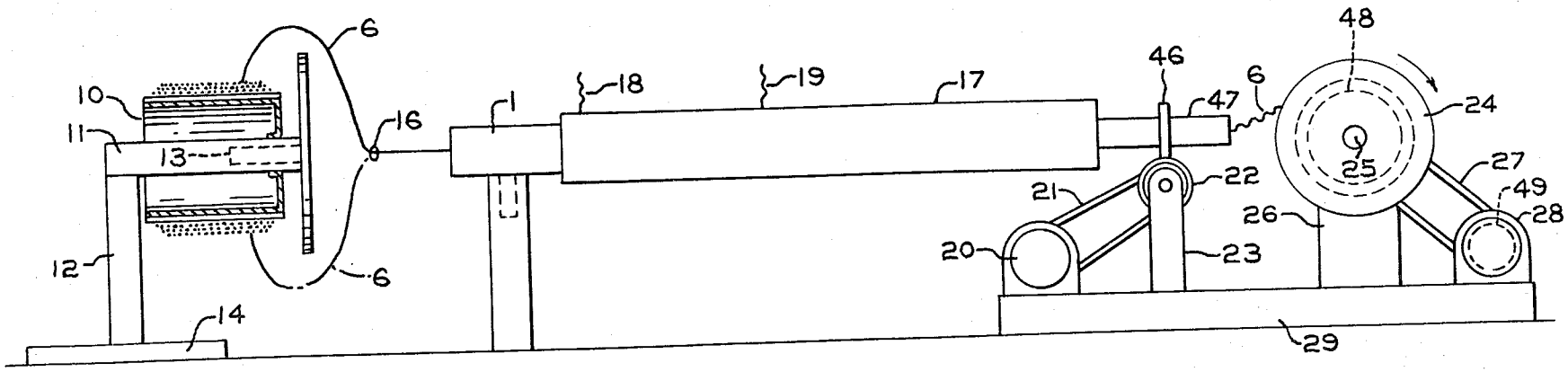
FIG. 4 is a yarn unifying and drying operation employing the jet of FIG. 1.

In FIG. 4, a process for producing a dried textile yarn from a wet textile forming package is illustrated. A glass fiber yarn forming package 10 is shown supported on tube 11 which is mounted on stand 12 which is supported by the base or floor 14. A round plate 15 having a central pin 13 which is received on the interior of tube 11 is provided in a spaced relationship from the package 10. The diameter of the plate 15 exceeds that of the package 10 considerably and during the operation of the process forces the yarn 6 removed from the package 10 to balloon over it, thus preventing the yarn 6 from snagging or sluffing off the package 10. The yarn 6 is passed through a guide eye 16 after removal from the package 10 and is passed into the fluid jet 1.

The yarn 6, after passing through the fluid jet 1, is passed through an elongated tube 17 which is provided on its interior with a heater, typically a resistance heater. The heater, not shown, is supplied with suitable energy from a power source through electrical leads 18 and 19. Temperatures of 425° C. to 650° C. are typically maintained in this zone. At yarn speeds of 3000 to 4000 feet per minute (914.4 to 1,219.2 meters per minute), these temperatures adequately remove moisture from wet yarn 6 having about 9 percent by weight moisture thereon.

The yarn 6 is collected on a spool 24 by passing it through exit tube 47 from the tube 17. The tube 47 is traversed across the width of the spool 24. The traversing of the tube 47 is provided by the motor 20 which rotates pulleys 22 and its belt 21. The belt 21 in turn rotates a shaft and cam, not shown. A cam follower, not shown, rides on the cam tracks of the cam and is in turn connected to member 46 which thus reciprocates tube 47. The spool 24 rotates through shaft 25 which is connected through pulley 48, belt 27 and pulley 49 to the rotating shaft of the motor 28. The operation of this drying process is more fully described in U.S. Application Ser. No. 637,346, filed Dec. 3, 1975, now U.S. Pat. No. 4,020,623 granted May 3, 1971, and incorporated herein by reference.

Under the rather high tensions of this process, the yarn 6 produced is generally well-compacted and rounded in form. However, under these tensions, the yarn 6 is not texturized.

Figure 5:
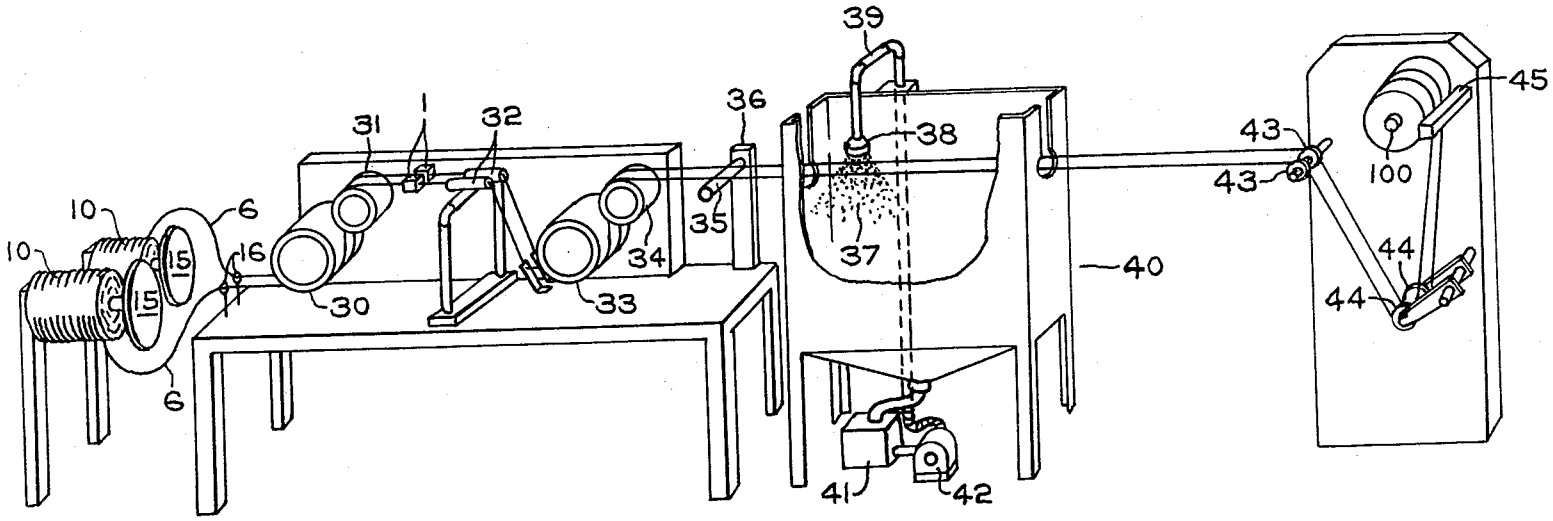
FIG. 5 is a texturizing operation employing the jet of FIG. 1.

FIG. 5 illustrates an operation for texturizing or producing a slub yarn. In this figure, the yarns 6 are removed from the packages 10 and pass over the exterior of wheels 15 and through eyelets 16, as in FIG. 4, so that the yarns 6 can be removed from the outside of the packages 10 without any snagging. The yarns 6 are then passed over the surface of a drive roll 30 coupled for rotation to a suitable drive source (not shown) and subsequently over a nip roller 31 journaled for rotation with its outer cylindrical surface in frictional contact with the outer cylindrical surface of the drive roll 30. Yarns 6 are then passed from the surface of the nip roll 31 through fluid jets 1. Based upon the desired result, as will be more fully described below, the yarns 6, after emerging from the jets 1, may be passed through fluid jets 32. These jets 32 are standard jets used to texturize yarn surfaces and are described in detail in U.S. Pat. Nos. 2,783,609; 3,328,826 and 3,381,346, which are incorporated herein by reference. The yarns 6 are then passed over roll 33 which is coupled to a power source for rotation (not shown). The yarns 6 then pass from roll 33 over the surface of nip roll 34 which is journaled for rotation with its outer cylindrical surface in frictional contact with the outer cylindrical surface of roll 33. Yarns 6 are then passed over guide bar 35 mounted on a bracket 36 and the yarns are passed under the binder spray head 38 which applies binder 37 to the yarns 6. Binder 37 is pumped to the spray head 38 by a pump 42 through pipe 39 from a binder reservoir 41. Excess binder is collected continuously in reservoir 41 by a suitable drain arrangement in the bottom of the binder applicator zone 40.

The binder used can be any desired composition so long as it can be applied through the spray head 38. Thus, binders containing starches, oils, resin, hot melts or solvent type materials and the like, including emulsions, suspensions, dilutions and the like can be utilized.

Yarns 6 are passed to the winding operation after binder 37 is applied thereto by passing them over rolls 43. The yarns 6 are then passed over tension rolls 44 which coact with a motor (not shown) driving mandrel 100 to maintain constant tension on the yarns 6 during winding and maintain a constant take-up winding speed for the yarns. The yarns 6 are wound in two packages on winder 100 which is equipped with a roller ball 45 to maintain the packages smooth on the surface and square ended. The winder employed is more fully described in U.S. Pat. No. 3,814,339, which is incorporated herein by reference.

As previously mentioned, the yarns 6 may be passed through either fluid jets 1 alone or a combination of fluid jets 1 and 32, depending upon the desired texturized qualities for the yarns. The tension on the yarns 6 as they are passed through the jets 1, and optionally 32, is controlled by the relative speeds of drive rolls 30 and 33. Drive roll 30 is maintained at a speed somewhat in excess of drive roll 33, the speed differential being termed as the percent overfeed of the yarn. Typically, this percentage overfeed is from 1 to 10 percent or more. If the fluid jet 1 is employed in combination with jet 32, its fluid pressure is adjusted so that the fluid jet merely produces a well-consolidated and rounded strand, as in the apparatus of FIG. 4, with the bulk of the texturizing being accomplished by the fluid jet 32. If, however, the fluid jet 1 is employed alone to texturize the yarn, the speed of passage of the yarn, the tension on the yarn and the fluid pressure in the jet 1 are adjusted to produce the desired texturized or slub yarn, as previously described. Thus, employment of the method of the present invention allows great variations in the types of texturized and slub novelty yarns which can be produced.

Figure 6:
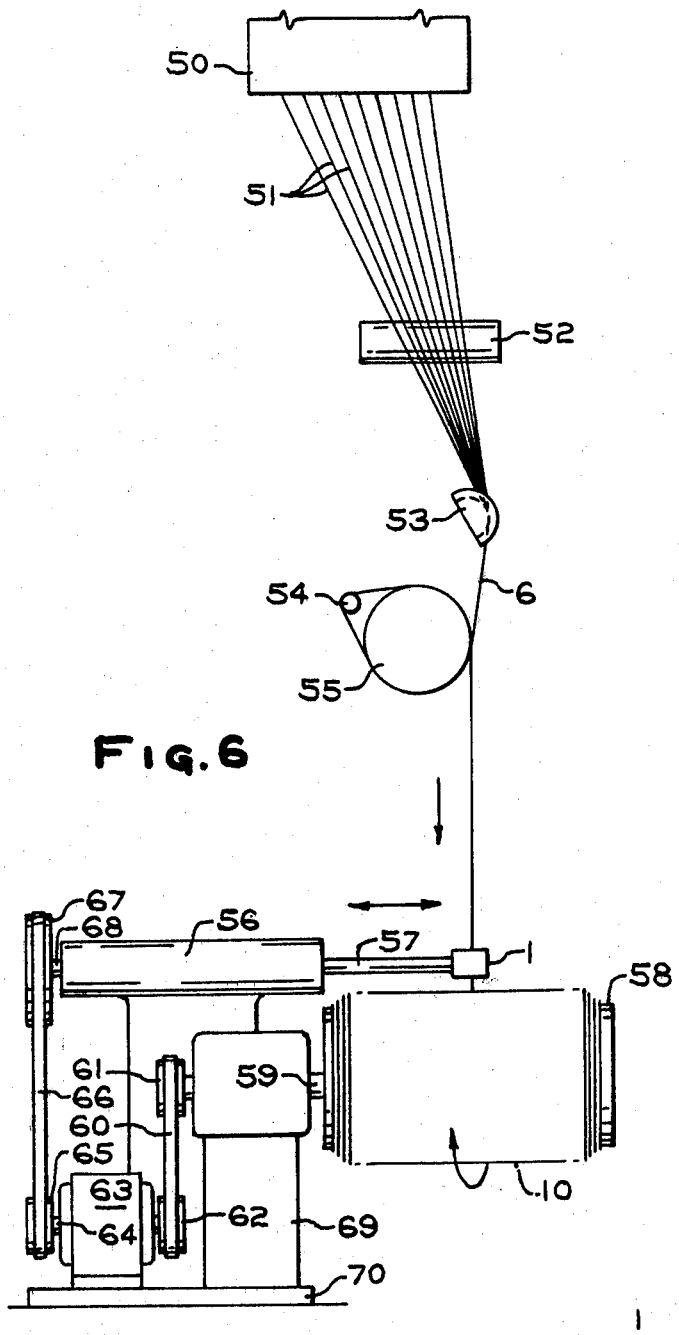
FIG. 6 is a glass yarn forming employing the jet of FIG. 1.

FIG. 6 illustrates the formation of a glass fiber yarn forming package with the employment of the method of the present invention. A plurality of glass filaments 51 are drawn from a glass fiber forming bushing 50. The filaments 51 are passed over an applicator roll 52 which applies a suitable binder and/or size to the filaments 51. The filaments 51 are then passed over a gathering shoe 53, which is typically a grooved wheel or cylinder formed of a material such as graphite, and which may be stationary or slowly rotated, which consolidates the filaments 51 into a unitary glass fiber yarn 6. Yarn 6 is passed around a motorized godet 55 provided with a smaller free-rolling wheel 54 or a guide shoe used to space the strand wrap on the godet 55 to prevent tangling on the godet surface. The godet is used to cause tension reduction to the yarn 6. The yarn 6 passes from the godet 55 into the fluid jet 1 which has the configuration shown in FIGS. 1, 2 and 3.

Suitable godets for use with the instant invention are those which are described in U.S. Pat. No. 3,532,478, which is incorporated herein by reference. In general, the godet is a smooth surfaced wheel which is positively driven by a suitable motor at a speed such that it tends to push the yarns passing over its surface at a rate slightly in excess of the normal yarn travel speed caused by the winder attenuation. By imparting a slight thrust to the yarn during its passage over the godet, the yarn tension normally associated with the attenuation from the winder is reduced considerably to provide a low tension yarn for feed to the fluid jet 1, the tension being low enough to permit consolidation and rounding of the yarn 6 or even texturizing or slubbing of the yarn 6.

In the embodiment shown in FIG. 6, the fluid jet is reciprocated in a horizontal direction as a rod 57 moves right to left and back across the width of a winder 58. Winder 58 is driven by a shaft 59 through pulleys 61 and 62. Pulley 62 is turned by the shaft 64 of a motor 63 and the belt 60, which engages pulley 62 and drives pulley 61 and the shaft 59 to rotate winder 58.

Shaft 64 also rotates a pulley 65 which is engaged by a belt 66 which engages pulley 67. Pulley 67 engages a shaft 68 and rotates it.

The rotation of shaft 68 is translated by proper gears and cams, not shown, but positioned in unit 56, into forces providing for the longitudinal movement of the shaft 57.

The passage of the yarn 6 through the generally figure-eight shaped fluid jet 1 imparts a curvilinear wave form to the yarn 6, as it exits from the fluid jet 1. The yarn 6 is immediately wound on the winder 58 with the wave form intact, thus producing a low tension wound yarn 6. This microtraversing action to the yarn 6 causes the yarn 6 to be displaced from a straight cylindrical wind on the winder 58, and thus eliminates the need for traversing spirals typically employed in the winding of glass fiber yarns.

Figure 7:
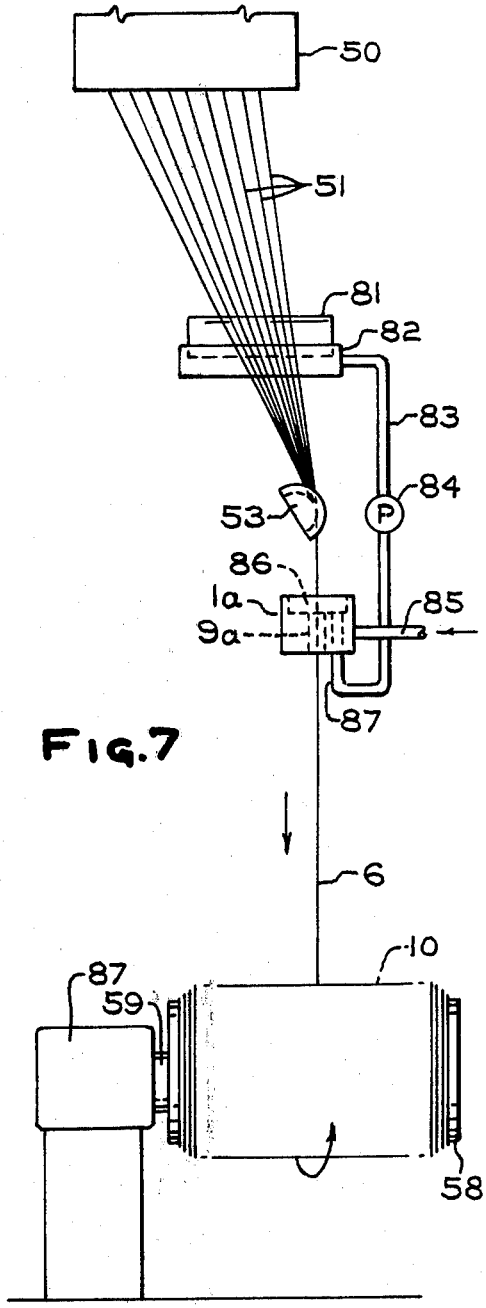
FIG. 7 is a glass forming and binder recovery operation employing a modified jet according to the present invention.

FIG. 7 illustrates the use of a modified form of the fluid treating jet which may also be employed in the present invention. In FIG. 7, there is illustrated a glass fiber forming bushing 50 from which a plurality of glass filaments 51 are being drawn. The filaments 51 are passed over the surface of a roller 81 which is housed in a receptacle or tank 82. The roller 81 is thus the application surface and the tank or receptacle 82 contains the binder and/or size for the filaments 51. The filaments 51 pass from roller 81 into gathering shoe 53 where they emerge as a consolidated bundle of filaments or yarn 6. Yarn 6 is passed through the modified jet 1*a* and the yarn is then wound into a package 10 on a winding mandrel 58 associated with a motor (not shown) within winder 87 and motor shaft 59. The modified fluid jet 1*a* contains a sump 86 which communicates with pipe 87 which has a pump means 84 associated therewith. Pipe 83 is in communication with the tank 82. The fluid jet 1*a* is provided with a central passageway 9*a*, which is the generally figure-eight passageway illustrated in FIGS. 1, 2 and 3, through which the yarn 6 is passed in its travel from the gathering shoe 53 to the surface of the mandrel 58. The jet 1*a* receives treating fluid through intake line 85.

In operation, as the yarn 6 passes through the modified jet 1*a*, in addition to rounding and consolidating the strand, the jet 1*a* removes excess binder and/or size from the yarn 6, with this excess binder and/or size being collected in sump 86 and returned to the tank or reservoir 82, thus recovering and recirculating excess binder from the yarn 6. The operation of such a system is more fully described in co-pending U.S. Application Ser. No. 762,360, now abandoned, which is incorporated herein by reference.

From the foregoing, it is obvious that the method of the present invention can be utilized to provide textile yarns having numerous and varied characteristics.

While the invention has been described with reference to certain specific embodiments thereof, it is not intended to be so limited thereby, except as set forth in the accompanying claims.

I claim:

1. A method of preparing an untwisted textile yarn comprising passing a low tension textile yarn through a fluid jet having a pair of passageways along its length, said passageways being interconnected and overlapped along their lengths and each passageway having at least one fluid inlet in fluid flow communication therewith, introducing the strand into one of said passageways while directing a fluid circumferentially around each passageway to thereby treat said yarn with said fluid while moving the yarn around the wall of said passageway for a single revolution with said fluid, passing said yarn to said second passageway while directing a fluid circumferentially around said second passageway in the opposing direction to said directing of said fluid in said first passageway to thereby treat said yarn with said fluid in said second passageway while moving the strand around the wall of said second passageway for a single revolution with said fluid in said second passageway and alternating said yarn between said passageways continuously by means of said fluid in said first passageway and said fluid in said second passageway during its passage through the jet to thereby produce a slubby yarn free from twist.

2. The method of claim 1 wherein said yarn is wet as it enters the fluid jet and wherein said yarn is dried after treatment in the fluid jet.

3. The method of claim 1 wherein said fluid jet is supplied with a gaseous fluid.

4. The method of claim 1 further comprising applying a binder and/or size to the yarn prior to its entry into the fluid jet and removing excess binder and/or size from the year with the fluid jet.

* * * * *

UNITED STATES PATENT AND TRADEMARK OFFICE

CERTIFICATE OF CORRECTION

PATENT NO. : 4,307,497

DATED : December 29, 1981

INVENTOR(S) : Warren W. Drummond

It is certified that error appears in the above-identified patent and that said Letters Patent are hereby corrected as shown below:

Column 4, line 44, after "from" insert --passageway 4 to--.

Column 5, line 19, "1971" should be --1977--.

Column 6, line 1, "ball" should be --bail--.

Column 2, line 34, "rension" should be -- tension --.

Column 8, line 45, "year" should be -- yarn --.

Signed and Sealed this

*Eleventh* Day of *May 1982*

[SEAL]

*Attest:*

GERALD J. MOSSINGHOFF

*Attesting Officer*

*Commissioner of Patents and Trademarks*